US008561449B2

(12) United States Patent
Veit et al.

(10) Patent No.: US 8,561,449 B2
(45) Date of Patent: Oct. 22, 2013

(54) BENDING APPARATUS FOR ROD-SHAPED WORKPIECES

(75) Inventors: Gustav Veit, Reutlingen/Sondelfingen (DE); Frank Wieblen, Metzingen/Neuhausen (DE)

(73) Assignee: WAFIOS Aktiengesellschaft, Reutlingen (DE)

( * ) Notice: Subject to any disclaimer, the term of this patent is extended or adjusted under 35 U.S.C. 154(b) by 311 days.

(21) Appl. No.: 12/793,262

(22) Filed: Jun. 3, 2010

(65) Prior Publication Data

US 2010/0307213 A1 Dec. 9, 2010

(30) Foreign Application Priority Data

Jun. 5, 2009 (DE) ..... 10 2009 024 075

(51) Int. Cl.
*B21D 11/00* (2006.01)

(52) U.S. Cl.
USPC ..... 72/307; 72/150; 72/294; 72/157; 72/306; 72/389

(58) Field of Classification Search
USPC ..... 72/129, 131, 293, 294, 295, 296, 297, 72/306, 307, 130, 72, 149, 150, 156, 157, 72/173, 132
See application file for complete search history.

(56) References Cited

U.S. PATENT DOCUMENTS

| | | | | | |
|---|---|---|---|---|---|
| 2,768,692 | A * | 10/1956 | Engel | ..... | 83/345 |
| 3,129,621 | A * | 4/1964 | Makowski | ..... | 82/59 |
| 4,724,733 | A * | 2/1988 | Suarez et al. | ..... | 83/159 |
| 5,025,651 | A * | 6/1991 | Del Fabro et al. | ..... | 72/294 |
| 5,649,768 | A * | 7/1997 | Ohzono et al. | ..... | 384/43 |
| 6,434,993 | B1 * | 8/2002 | Broggi et al. | ..... | 72/157 |
| 7,234,333 | B2 * | 6/2007 | Maier et al. | ..... | 72/156 |
| 7,490,400 | B2 * | 2/2009 | Zurkirchen | ..... | 29/748 |
| 7,721,582 | B2 * | 5/2010 | Speck | ..... | 72/306 |

FOREIGN PATENT DOCUMENTS

| | | | |
|---|---|---|---|
| DE | 69003116 | T2 | 1/1994 |
| DE | 60103632 | T2 | 6/2005 |
| DE | 60219651 | T2 | 12/2007 |
| EP | 0 417 703 | A2 | 3/1991 |
| EP | 0 379 030 | B1 | 9/1993 |
| EP | 1 396 296 | A1 | 3/2004 |
| EP | 1 272 293 | B1 | 6/2004 |
| EP | 1 434 660 | B1 | 4/2007 |
| FR | 2 602 160 | | 2/1988 |
| JP | 3-169433 | | 7/1991 |

* cited by examiner

*Primary Examiner* — Dana Ross
*Assistant Examiner* — Homer Boyer
(74) *Attorney, Agent, or Firm* — Douglas J. Christensen

(57) ABSTRACT

In a bending apparatus for rod-shaped workpieces, comprising a machine frame to which a bending head with bending tools is attached, which bending head is movable relative to the frame, further a feed device upstream of the bending head for feeding the workpieces to the same, and a cutting device which can be displaced in the direction of feed of the workpieces and can be applied between bending head and feed device to the respective workpiece for cutting the same, the feed device can also be displaced in the direction of feed of the workpiece in addition to the cutting device, which occurs independent of the displacement of the cutting device.

17 Claims, 3 Drawing Sheets

BENDING APPARATUS FOR ROD-SHAPED WORKPIECES

This application claims priority to German Patent Application No. 10 2009 024 075.6 filed on Jun. 5, 2009, said application is incorporated herein by reference in it's entirety.

FIELD OF THE INVENTION

The invention relates to a bending apparatus for rod-shaped workpieces.

BACKGROUND OF THE INVENTION

It is principally desirable in bending apparatuses and especially such for bending rod-shaped workpieces to have the largest possible bending space so that there is also sufficient space for example for turning down the longest possible leg of a bending part when bending needs to be produced which is larger than 90° without parts of the bending machine representing an interference contour.

A bending machine is known from DE 602 19 651 T2 (corresponding to EP 1 434 660 B1) in which a feed device and two cutting devices are provided upstream of the bending head, one of which is fastened to the frame of the feed device and is displaceable with the same in the direction of the longitudinal axis of the workpiece to be processed. A further cutting device, which is stationary however, is attached between the feed device and the bending head, which cutting device represents a considerable interference contour however when a long leg is to be bent by more than 90°.

The arrangement of FR 2602160 A1 comprises a feed device and a cutting device which is displaceable along the longitudinal central axis of the workpiece in order to produce workpieces cut to size for the bending machine. The bending machine itself consists of a gripper unit and a displaceable bending head (or also two displaceable bending heads). This known bending installation requires overall a lot of space. Moreover, the bending head or bending heads rotate about the workpiece and considerably limit the available bending space. Moreover, a relatively long straight end piece also remains between the cut and the bending head in the construction as described there, which is also often undesirable.

DE 601 03 632 (EP 1 272 293 B1) describes a bending machine with a folding shank which is displaceable along the longitudinal central axis of the workpieces and to which a cutting device is fastened on the side facing away from the bending head, which cutting device can be displaced with the same. As a result of the length of the folding shank, this always leads to the consequence that there will always be a relatively long straight end piece of the workpiece between the cutting point and the bending head, which is often undesirable.

A bending apparatus of the kind mentioned above is known from DE 690 03 116 T2 (EP 0 379 030 B1), in which both the feed device and the bending unit can be lifted or lowered. A relatively long straight end piece of the workpiece remains in this known bending machine too between cutting point and bending head, with there also always being a very large distance between the feed unit and the bending head which may lead to difficulties especially in processing very thin wires.

SUMMARY OF THE INVENTION

The invention relates to a bending apparatus for rod-shaped workpieces, comprising a machine frame to which a bending head with a mandrel is attached, which bending head is movable relative to the frame, further a feed device upstream of the bending head for feeding the workpiece to the same, and a cutting device which can be displaced along the longitudinal central axis of the workpieces and can be applied between bending head and feed device to the respective workpiece for performing a cut.

On the basis of the above, features and advantages of the invention is a bending apparatus of the kind mentioned above in such a way that bending larger than 90° and with long legs of the workpiece can be performed, a sufficiently large bending space is available for this purpose and bending in which only a relatively small straight end piece of the workpiece remains between the cutting point and the bending head and also the distance between the feed unit and the bending head can be chosen to be especially small.

This is achieved in accordance with the invention in a bending machine of the kind mentioned above in such a way that the feed device can be displaced in the direction of feed of the workpiece in addition to the cutting unit, which occurs irrespective of the cutting device.

In an embodiment, not only the cutting device but also the upstream feed device that can be displaced in the direction of feed of the workpiece (and thus also against the same) in an embodiment in accordance with the invention, the cutting device and the feed device can be driven away from the bending head to a predetermined position which is remote from the same as far as possible, so that much space is available between the cutting device and the bending head for turning down a long leg of a bending part (workpiece). As a result of the displaceability of the feed device as provided in accordance with the invention, it can be ensured that the cutting device can also be displaced especially far away from the bending head.

If workpieces are to be bent where it is intended that only a relatively short straight end piece remains between bending head and cutting device, which is often desirable, the cutting device can be displaced close to and adjacent to the bending head through the displaceability of the cutting device independent of the feed device without requiring a displacement of the feed device at the same time, e.g. from a position remote from the bending head for example. If further the shortest possible distance between the feed device and the bending head is also to be ensured in order to prevent undesirable deformations in this area, especially in the case of processing thin wires, the feed device can be displaced to a position moved very close to the bending head in the case of a cutting device that has been moved entirely up to the bending head.

If the cutting device and the feed device are in a position remote from the bending head for example, then the invention offers the possibility that the cutting device is moved towards the bending head for the purpose of only performing the cutting process (at the end of the bending process) and the feed device remains in its position which is remote from the bending head.

An embodiment of the bending apparatus in accordance with the invention is that the cutting device and the feed device are each displaceable on a separate guideway, with the guideways being disposed parallel next to one another. This embodiment offers the possibility of enabling an especially close travel of the feed device to the mandrel (in its extreme forward position) through a suitable arrangement of cutting device and feed device. Only the section of the displaceable cutting device which performs the cut is disposed between feed device and bending head, which cutting device is still interposed also in the extreme forward position between bending head and feed device, and the remaining part of the cutting device, including the motor for the process, can be arranged among other things laterally adjacent to the feed device and parallel to the same. It is thus possible to realize an especially short straight end piece of the workpiece between cutting point and bending head. It is advantageous when each guideway comprises two parallel guide strips, so that storage and displaceability can occur in each case on two parallel rails both in the cutting device and in the feed device, contributing to an especially low-vibration and stable overall construction.

The two guideways preferably consist of three parallel guide strips, with each guideway consisting of the middle of these guide strips and one of the two other guide strips. The two guideways with two parallel guide strips each can be realized in this embodiment with especially little effort, with the middle guide strip being used as a single-side guide support both for the cutting device and for the feed device.

A rack is applied in such an embodiment, preferably directly adjacent to the middle guide strip, which rack is in engagement with a drive pinion which is attached to the bottom side of the cutting device and to the bottom side of the feed device for performing the displacement movement of the two devices. The pinion of each of the two devices is driven by a motor which is arranged on the respective device and is displaceable with the same.

An embodiment of the invention is also that the cutting device comprises a base plate from which a support arm which holds a movable cutting knife and a fixed counter-knife for performing a cut protrudes into the feed axis of the respectively conveyed workpiece that the workpiece coming from the feed device extends between the two knives. Since the two knives are attached in this case on a protruding support arm, this provides the possibility to allow only this support arm with the knives to protrude into the feed axis of the workpiece and to otherwise allow the arm to run out of the feed axis of the workpiece, so that the motor for driving the knives and the carriage as well as the motor for displacing the cutting device can be attached at a distance from the feed axis of the workpiece. This allows the feed device to move very closely to the bending head in its extreme forward position, so that only the width of the support arm with the two knives is interposed between itself and the bending head, thus resulting in especially short straight end pieces of the workpiece after the cut.

Preferably the fixed counter-knife is fixed on the support arm in this embodiment of the invention, and the cutting knife is mounted directly adjacent to the counter-knife on a lever swivelably attached to the support arm, as seen in the direction of feed of the workpiece, which lever can be swiveled about a swiveling axis parallel to the direction of feed of the workpiece for the purpose of performing the cut.

In an embodiment of the bending apparatus in accordance with the invention, the bending head is attached to the front face side of the machine frame, with the same being (also preferably) displaceable on curved guides which are attached to the front face side of the machine frame transversally to the longitudinal direction of the workpiece in such a way that the bending head is swiveled about the central axis of the workpiece. This means therefore that these curved guides are configured and attached in such a way that their central point of curvature sits in the central axis of the workpiece, so that a lateral swiveling movement of the bending head on these curved guides will always lead to a swiveling of the bending head about the center of the workpiece.

A further embodiment of the invention is that the feed device is associated upstream with an aligning device which can be jointly moved with the same (with the term "upstream" and "downstream" being used herein always within the sense of a reference to the direction of transport of the supplied workpiece). This leads to the advantage that during a return travel of the feed device the workpiece need not be pushed back by the aligning device which is upstream of the same.

The invention advantageously comprises several pairs of feed rollers for the feed device, which feed rollers are fixed to a rotating frame which can be swiveled about the longitudinal axis of the workpiece, with the aligning device preferably being attached jointly with the rotating frame of the feed device to be swivelable about the central axis of the workpiece. This also offers the possibility to produce three-dimensional bending parts.

Finally, it is further advantageous in the invention when the bending head is attached to be displaceable in two mutually perpendicular directions and perpendicular to the central axis of the workpiece, in addition to its swivelability on the curved guides.

DESCRIPTION OF THE DRAWINGS

The invention is now explained in closer detail in principle by way of example by reference to the drawings, wherein.

DETAILED DESCRIPTION

Figure 1:
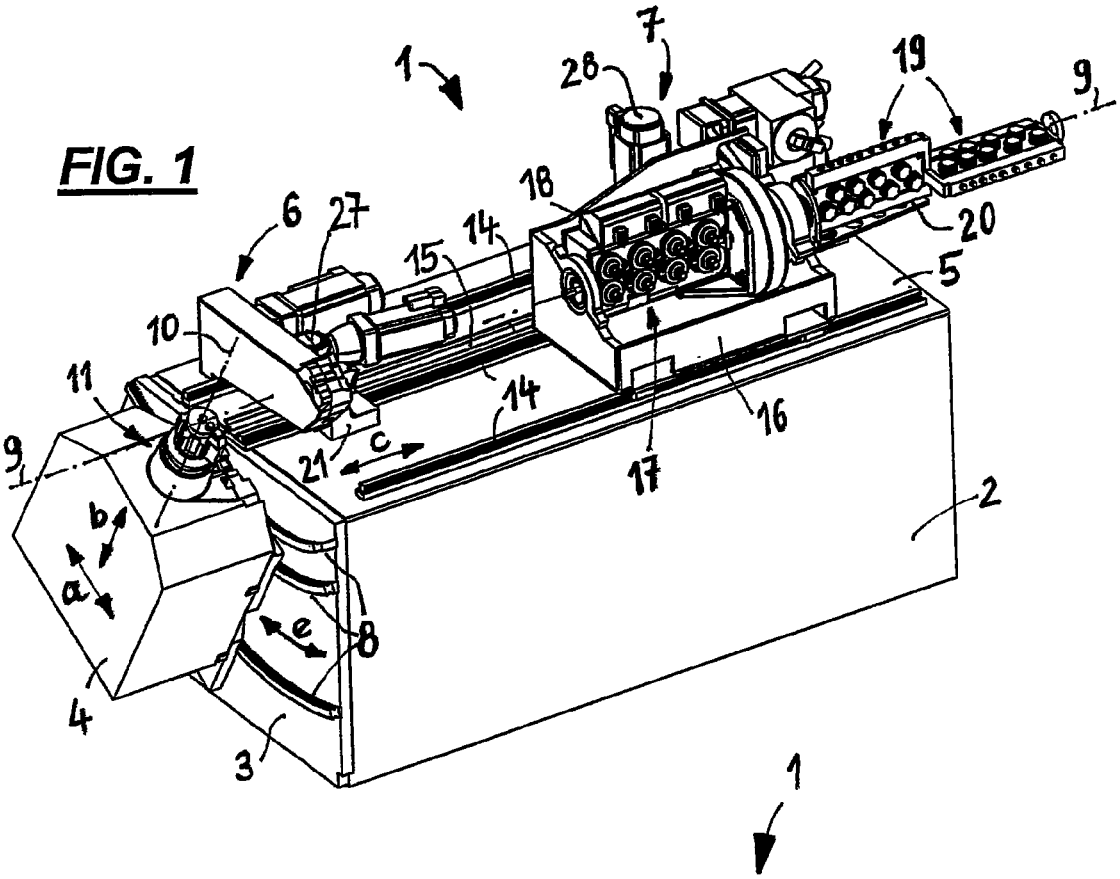
FIG. 1 shows a perspective side view of a bending apparatus in accordance with the invention.
Figure 2:
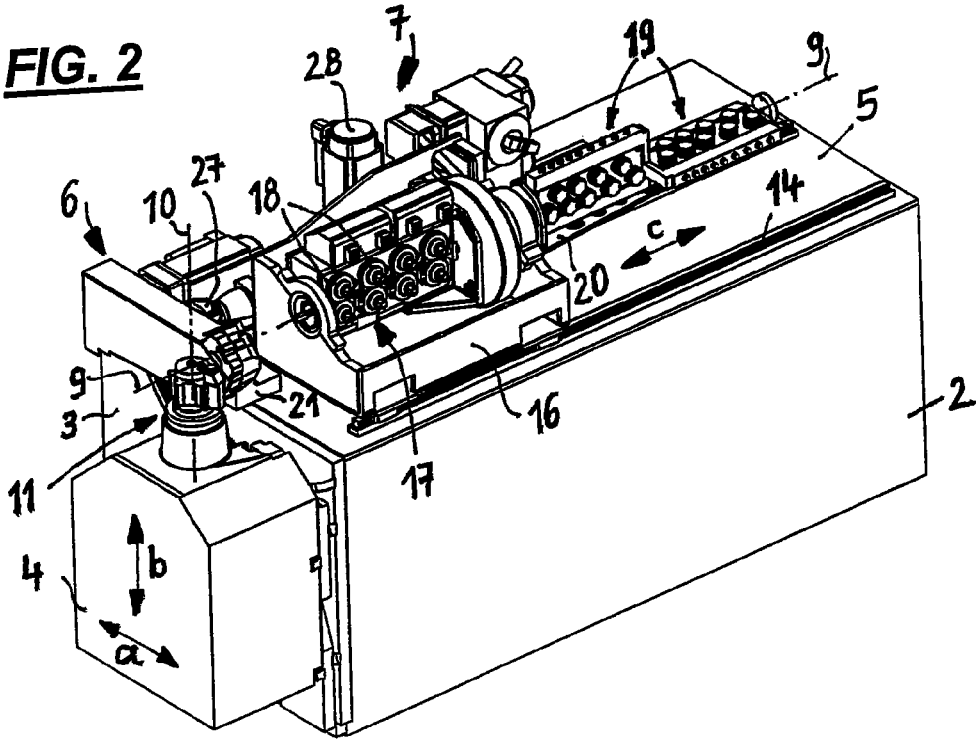
FIG. 2 shows a perspective view of the apparatus of FIG. 1 (in the same perspective), but with a displacement position of the cutting device and feed device which differs from that of FIG. 1.

FIGS. 1 and 2 show a perspective view diagonally from above of a bending machine 1, comprising a machine frame 2, a bending head 4 attached to the face side 3 of the same and a cutting device 6 attached to the upper side 5 of the machine frame 2 and a feed and aligning device 7.

The bending head 4 sits on arc-shaped curved guide strips (curved guides) 8 which are arranged and configured in such a way that their central point of curvature lies in the central axis 9 of the supplied workpiece. During a lateral swiveling of the bending head 4 along the curved guides 8, a swiveling movement of the bending head 4 about the center of the workpiece is thus achieved, i.e. about the central axis 9 of the workpiece (swiveling movement e, cf. FIG. 1).

The bending head 4 is usually pre-positioned in a certain alignment and no longer swiveled during the ongoing production. There is still a possibility however to also swivel the bending head during the production process in the direction e.

The bending head 4 of the bending machine 1 is provided with four further axes of motion, of which two extend perpendicular with respect to one another and, in addition, each of them perpendicular to the central axis 9 of the workpiece.

As a result, the bending head 4 can be displaced perpendicularly (direction a) or also parallel (direction b) in relation to the bending axis 10 of the bending head 4. Moreover, the bending tools 11 are provided with two concentric rotational axes, with the first rotating the mandrel 12 and the second the counterholder or bending roll 13 about the bending axis 10 (cf. FIG. 3).

Three guide rails 14 and a rack 15 (cf. FIG. 3) are attached parallel to one another and parallel to the central axis 9 of the workpiece to the machine frame 2 on its upper side 5.

The front and middle guide rail 14 facing the spectator in the illustrations of the drawings jointly form a guideway on which the housing 16 of the feed and aligning unit 7 is attached in a displaceable manner (FIGS. 1 and 2). The feed device 17 (which is also known as "roller infeed") is attached to the housing 16 with several adjacently attached pairs of feed rollers 18 and two alignment devices 19 which are offset in relation to one another by 90° each.

Three drives are further provided on the housing 16 of the feed and aligning unit 7: The first drive 28 is used for moving the feed and aligning unit 7 on the guide rails 14 in the direction of feed c, the second drive allows the rotation of a rotating frame of the feed device 17, to which the pairs of feed rollers 18 are attached (and thus enabling a rotation of the workpiece clamped between the pairs of feed rollers 18) about the central axis 9 of the workpiece, and the third drive actuates the feed rollers 18, so that they can move the workpiece in the direction of its longitudinal or central axis 9.

The holder 20 of the alignment units 19 is fastened to the rotating frame of the feed device 17 and is rotatable with the same about the central axis 9 of the workpiece. The first drive 28 is in engagement via a pinion with the rack 15 which is attached to the machine housing 2, so that a respective displacement of the feed and aligning unit 7 in the direction c can occur depending on the direction in which the first drive 28 will act.

The middle and rear guide rail 14 jointly form a second guideway, on which a base plate 21 of the cutting device 6 is disposed in a displaceable manner, which also occurs in direction c. A solid support arm 22 with an inserted fixed counter-knife 23 protrudes from said base plate 21 into the central axis 9 (longitudinal axis) of the workpiece. A lever 24 with a cutting knife 25 inserted in the same is attached to the support arm 22 in a manner as to be swivelable about a swiveling axis 26 (movement d), with the swiveling axis 26 extending parallel to the central axis 9 of the workpiece (cf. FIG. 3).

Two drives are attached to the base plate 21 of the cutting device 6: The first drive is in engagement with the swivelable lever 24 via a crank and a link guide (not shown). By actuating this drive, the lever 24 is swiveled in relation to the support arm 22 and severs the workpiece running between the counter-knife 23 and the cutting knife 25.

Figure 3:
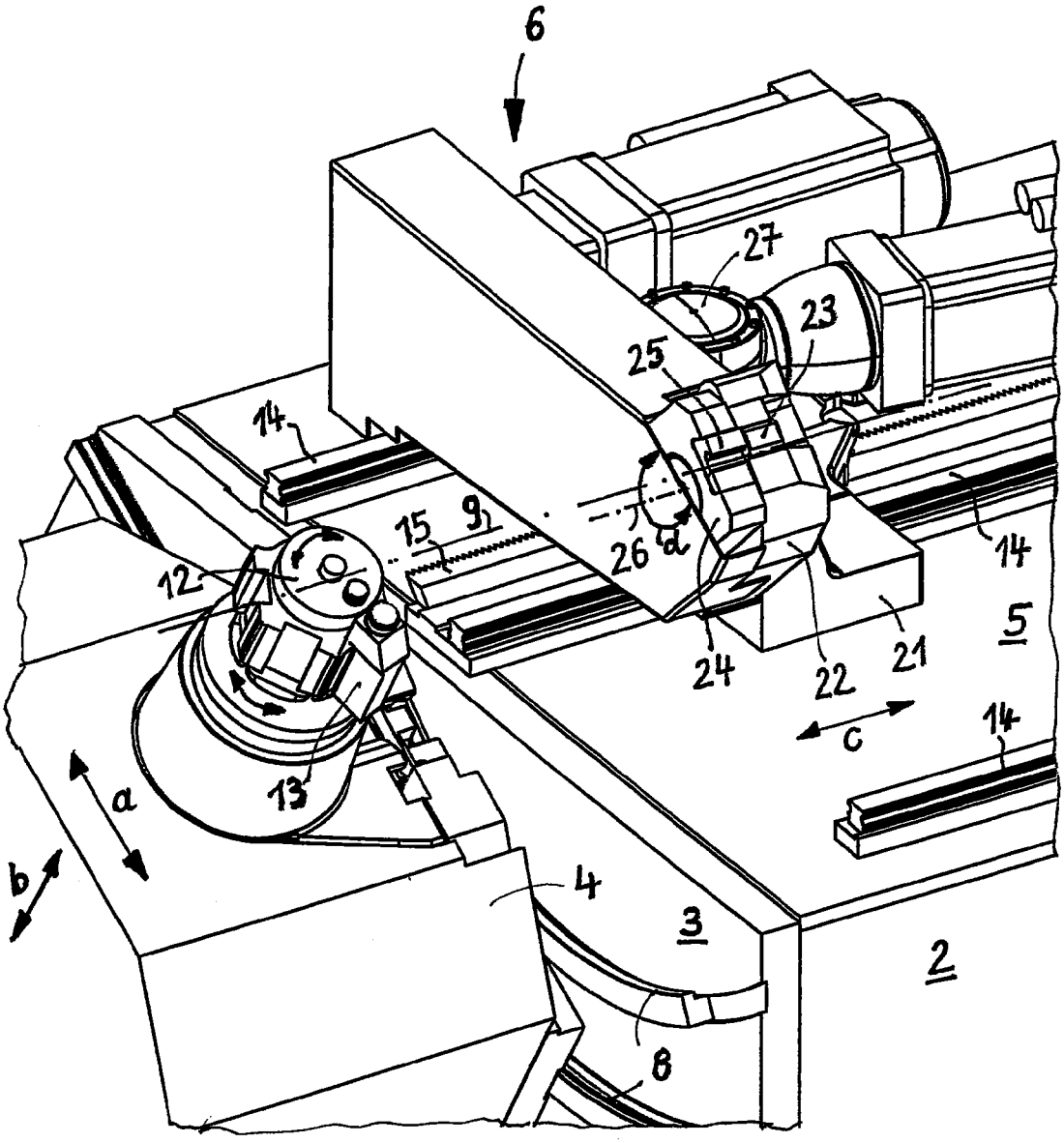
FIG. 3 shows an enlarged perspective detailed view of bending head and cutting device of the illustration of FIG. 1, and FIGS. 4, 5 and 6 each show a top view of a bending machine in accordance with the invention with different displacement positions of the bending and feed device, with FIG. 4 showing the displacement position of FIG. 2, FIG. 5 showing the displacement position similar to the one of FIG. 1 and FIG. 6 showing a displacement position in which the cutting device and the feed device are displaced to their displacement position which is remote at a maximum from the bending head.

The second drive 27 which is provided on the base plate 21 is in engagement with the rack 15 via a pinion (not shown again) and thus allows a displacement or positioning of the cutting device 6 along the direction of feed c (also see FIG. 3).

FIG. 1 shows the bending machine 1 in which the cutting device 6 has been displaced relatively far in the direction towards the bending head 4, but is not yet in its extreme forward displacement position, whereas the feed and aligning unit 7 is disposed relatively far from the bending head 4.

Figure 4:
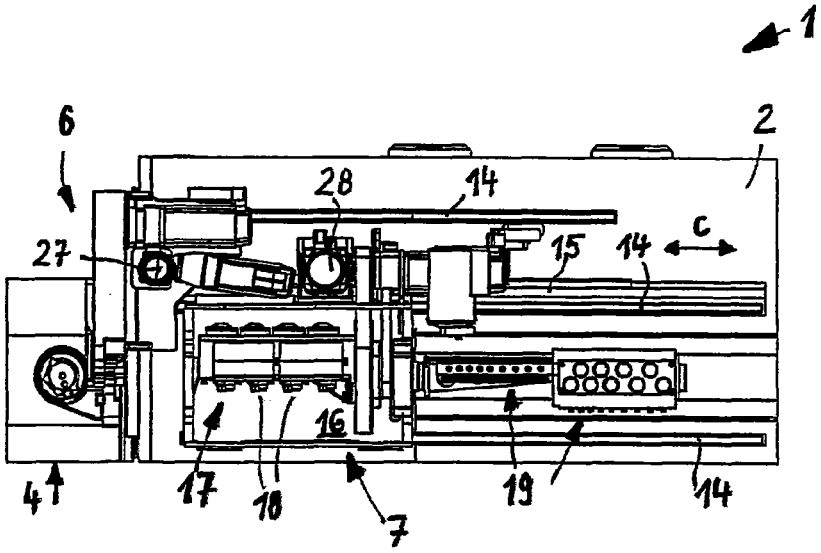

In the illustration of FIG. 2 on the other hand, the cutting device 6 has been displaced to its maximum front position in which the cutting knife 25 and the counter-knife 23 are disposed directly in front of the bending head 4 and also the feed and aligning unit 7 has been displaced to its extreme forward position, i.e. the position closest to the bending head 4, in which the housing 16 of the feed device 17 is disposed very close to the base plate 21 of the cutting device 6, as is shown in a top view of FIG. 4 (with the same displacement position).

Figure 5:
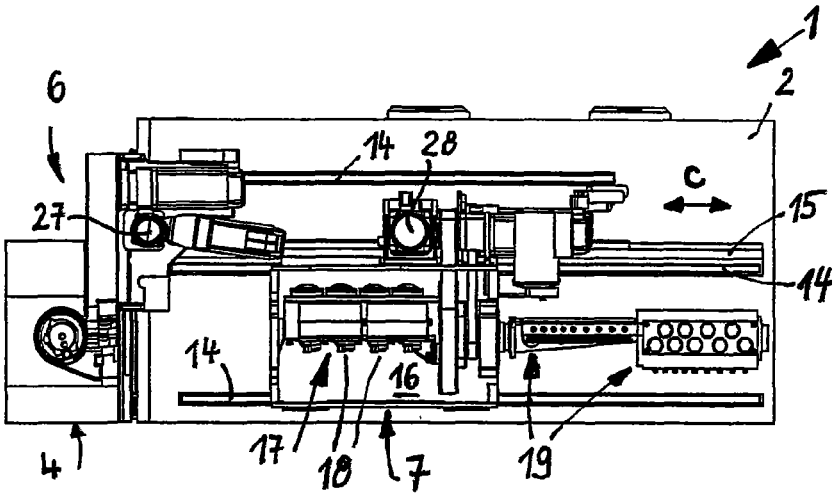

FIG. 5 shows a top view of the bending machine 1 in a position in which the cutting device 6 is disposed again in its extreme forward displacement position, but where the feed device is in a position remote from the bending head 4. The alignment of the bending head 4 is as shown in FIG. 2.

The illustrations of FIGS. 2 and 4 show that an only exceptionally short straight end leg is produced on the workpiece during a cut of the workpiece because the cutting point is disposed directly in front of the bending head 4. On the other hand, both drawings also show that in this case the cutting device 6 and the feed and aligning unit 7 represent a very considerable interference contour when it is necessary to make bends of more than 90° but with a long end leg.

Figure 6:
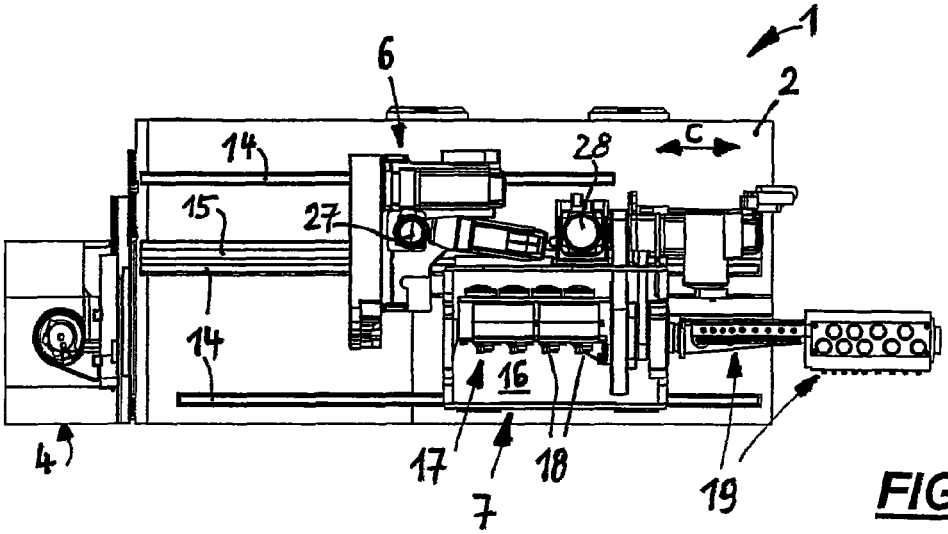

In order to enable such bending, the cutting device 6 and the feed and aligning device 7 can be displaced (independently from one another) to a position very remote from the bending head 4 along the guide rails 14, as is shown in top view of FIG. 6.

FIG. 6 shows the rearmost position of the cutting device 6 and the feed and aligning unit 7, i.e. the one that is farthest away from the bending head 4. A lot of space for turning down a long leg of a bending part is now available between the cutting device 6 (and the feed and aligning unit 7) and the bending head 4.

In the illustration of FIG. 5, the feed and aligning unit 7 is displaced over a certain path to the rear, i.e. away from the bending head. The cutting device 6 however, is currently disposed in its extreme forward cutting position in order to perform the cut.

It is tried during the bending to keep the feeder (feed and aligning unit 7) and the cutting device 6 as far as possible in a front position. If a long leg needs to bent by more than 90°, the cutting device 6 and the feed and aligning unit 7 are displaced to the rear to the position as shown in FIG. 6. In order to ensure however that the workpiece does not move with the feed and aligning unit 7 to the rear when it is moved away from the bending head 4, the device is controlled in such way that the workpiece is advanced via the pairs of feed rollers 18 with the same speed with which the feed and aligning unit 7 from the bending head 4, through which the workpiece stands still in relation to the bending head 4. The cutting device 6 is moved forward again for the purpose of severing the workpiece.

In FIGS. 1 and 2, the alignment of the bending head 4 relative to the machine frame 2 is arranged differently. Whereas in the FIG. 2 the bending head 4 is swiveled in such a way that the bending axis 10 extends in a precisely perpendicular way, the position of the bending head 4 in FIG. 1 is swiveled slightly by displacement of the same laterally along the arc-shaped curved guide strips 8.

Depending on the part to be produced, the alignment of the bending head 4 occurs differently. An obliquely positioned bending head 4, which is shown in FIG. 1 in a principal way, allows the workpiece to be processed to drop after bending. When the bending head 4 stands perpendicularly, as shown in FIG. 2, the bent part can be removed from the bending table by means of grippers.

Notice shall be taken with respect to the illustrated embodiment of the bending machine 1 that the rotational movement of the feed and aligning unit 7 about the central axis 9 of the workpiece is not absolutely necessary. It is also possible that the bending head 4 is swiveled about the workpiece or only two-dimensional bent parts could be produced.

Similarly, embodiments other than the shown drive variants could be used for the feeding of the cutting device 6 and the feed and aligning unit 7, e.g. via a spindle drive, belt drive, etc., even though a separate drive would need to be provided in case of a spindle drive for each of the two devices 6 and 7.

It is also possible to use a different number of guide rails 14, e.g. only two or also four. Similarly, rotating aligning wings could be used for aligning with the aligning units 19 for example, which enable an improved straightness of the workpiece. It is also known to bring different aligning units in engagement and out of engagement with the workpiece (rotating aligning/roller flatting; small wire diameter/large wire diameter) by swiveling or displacement.

Similarly, the use of a guide wheel (spill) at the rear of the aligning unit could be provided which reduces the twisting of the workpiece.

The invention claimed is:

1. A bending apparatus for rod-shaped workpieces, comprising:

a machine frame;

a bending head with an attached rotatable mandrel, the bending head attached to and movable relative to the machine frame;

a feed device attached to the machine frame upstream of and separated from the bending head for feeding the workpiece to the bending head along a feed axis, the feed device displaceable on a linear guideway on the machine frame in a direction of the feed axis a travel distance from an extreme forward position close to the bending head to a position separated from the bending head, the feed device comprising a plurality of pairs of feed rollers; and a cutting device disposed between the bending head and the feed device that is displaceable in a direction of the feed axis along a linear guideway extending side-by-side to and parallel to the guideway associated with the feed device, the cutting device for cutting the workpiece between the bending head and the feed device, and wherein the feed device is displaceable in the direction of feed of the workpiece independently of the displacement of the cutting device, whereby the cutting device is travelable most of the travel distance of the feed device alongside the feed device.

2. The bending apparatus according to claim 1, wherein the cutting device is displaceable in the direction of feed of the workpieces on the guideway on top of the machine frame and the feed device is displaceable in the direction of feed of the workpieces on the separate guideway on top of the machine frame, the guideways being disposed in a parallel arrangement substantially the length of the machine frame.

3. The bending apparatus according to claim 2, wherein each guideway comprises two parallel guide strips.

4. The bending apparatus according to claim 3, wherein the two guideways comprise three parallel guide strips, each guideway consisting of the middle guide strip and one of the two other guide strips.

5. The bending apparatus according to claim 4, wherein a rack is attached directly adjacent to the middle guide strip, the rack in engagement with a pinion attached to the bottom side of the cutting device and the feed device for performing the displacement motion of the two devices.

6. The bending apparatus claim 1, the cutting device comprising:

a base plate;

a support arm fastened to the base plate;

a motor for the cutting device positioned laterally outside of the feed device, whereby, when the feed device is in the extreme forward position, the motor is laterally adjacent to the feed device and parallel to said feed device;

a movable cutting knife and a fixed counter-knife held by the support arm, so that the movable cutting knife and fixed counter-knife protrude into the feed axis of the workpiece so that the workpiece extends between the knives.

7. The bending apparatus according to claim 6, wherein the fixed counter-knife is fastened to the support arm and the cutting knife sits directly adjacent to the counter-knife on a lever swivelably attached to the support arm, swivelable about a swiveling axis parallel to the direction of feed of the workpiece.

8. The bending apparatus according to claim 1, wherein the bending head is attached to a front face side of the machine frame.

9. A bending apparatus for rod-shaped workpieces, comprising:

a machine frame;

a bending head with an attached mandrel, the bending head attached to and movable relative to the machine frame;

a feed device attached to the machine frame upstream of and separated from the bending head for feeding the workpiece to the bending head along a feed axis, the feed device displaceable with respect to the machine frame in a direction of the feed axis; and a cutting device disposed between the bending head and the feed device that is displaceable in a direction of the feed axis, the cutting device for cutting the workpiece between the bending head and the feed device, and wherein the feed device is displaceable in the direction of feed of the workpiece independently of the displacement of the cutting device;

wherein the bending head is attached to a front face side of the machine frame and wherein the bending head is displaceable on arc-shaped guides attached to the front face side of the machine frame transversally to the longitudinal direction of the workpiece, whereby the bending head is swivelable about the central axis of the workpiece.

10. The bending apparatus according to claim 1, further comprising an aligning device and wherein the feed device is associated upstream with the aligning device and is jointly displaceable with the aligning device.

11. The bending apparatus according to claim 1, wherein the feed device comprises several pairs of feed rollers which are fastened to a rotary frame swivelable about the longitudinal axis of the workpiece.

12. The bending apparatus according to claim 9, wherein the feed device comprises several pairs of feed rollers which are fastened to a rotary frame swivelable about the longitudinal axis of the workpiece.

13. The bending apparatus according to claim 11, wherein the aligning unit is swivelable about the central axis of the workpiece together with the rotary frame of the feed device.

14. The bending apparatus according to claim 1, wherein the bending head is displaceable in two directions perpendicular to each other and each perpendicular to the central axis of the workpiece.

15. The bending apparatus according to claim 7, wherein the bending head is displaceable in two directions perpendicular to each other and each perpendicular to the central axis of the workpiece.

16. The bending apparatus according to claim 9, wherein the bending head is displaceable in two directions perpendicular to each other and each perpendicular to the central axis of the workpiece.

17. A bending apparatus for rod-shaped workpieces, comprising:

a machine frame having a length;

a bending head with an attached rotatable mandrel, the bending head attached to the front of the machine frame and movable relative to the machine frame;

a feed device attached to the machine frame upstream of and separated from the bending head for feeding the workpiece to the bending head along a feed axis by way of feed rollers, the feed device movable on a linear guideway on the machine frame along and parallel to the feed axis a travel distance from an extreme forward position close to the bending head to a position separated from the bending head, the linear guideway extending substantially the length of the machine frame; and a cutting device comprising a motor and a support arm with a cutting knife, the cutting device displaceable on a linear guideway next to the feed device with the support arm extending inwardly toward the feed axis, whereby, when the feed device is at the extreme forward position, the feed device is positioned intermediate the feed device and the motor of the cutting device, and the arm of the cutting device extends inwardly to the feed axis forward of the feed device, and wherein the cutting device is travelable most of the travel distance of the feed device alongside the feed device.

* * * * *

UNITED STATES PATENT AND TRADEMARK OFFICE

CERTIFICATE OF CORRECTION

PATENT NO. : 8,561,449 B2
APPLICATION NO. : 12/793262
DATED : October 22, 2013
INVENTOR(S) : Gustav Veit et al.

It is certified that error appears in the above-identified patent and that said Letters Patent is hereby corrected as shown below:

On the Title page, item (75) Inventor:

"Gustav Veit, Reutlingen/Sondelfingen (DE); Frank Wieblen, Metzingen/Neuhausen (DE)"

should be:

Gustav Veit, Reutlingen/Sondelfingen (DE); Frank Weiblen, Metzingen/Neuhausen (DE)

Signed and Sealed this
Twenty-second Day of April, 2014

Michelle K. Lee

Michelle K. Lee
*Deputy Director of the United States Patent and Trademark Office*